US007288709B2

(12) United States Patent
Chiba

(10) Patent No.: US 7,288,709 B2
(45) Date of Patent: Oct. 30, 2007

(54) TUNING DEVICE AND TUNING METHOD

(75) Inventor: Mitsuharu Chiba, Chiba (JP)

(73) Assignee: Seiko Instruments Inc. (JP)

( * ) Notice: Subject to any disclaimer, the term of this patent is extended or adjusted under 35 U.S.C. 154(b) by 249 days.

(21) Appl. No.: 11/071,717

(22) Filed: Mar. 3, 2005

(65) Prior Publication Data

US 2005/0211064 A1 Sep. 29, 2005

(30) Foreign Application Priority Data

Mar. 15, 2004 (JP) ..... 2004-072659

(51) Int. Cl.
*G10G 7/02* (2006.01)

(52) U.S. Cl. ..... 84/454

(58) Field of Classification Search ..... 84/454
See application file for complete search history.

(56) References Cited

U.S. PATENT DOCUMENTS 4,205,584 A * 6/1980 Foerst ..... 84/454
4,354,418 A * 10/1982 Moravec et al. ..... 84/454
4,523,506 A * 6/1985 Hollimon ..... 84/454
5,070,754 A * 12/1991 Adamson ..... 84/454
5,285,711 A * 2/1994 Sanderson ..... 84/454
5,756,913 A * 5/1998 Gilmore ..... 84/454
5,767,429 A * 6/1998 Milano et al. ..... 84/454
5,773,737 A * 6/1998 Reyburn ..... 84/454
5,777,248 A * 7/1998 Campbell ..... 84/454
5,780,759 A * 7/1998 Szalay ..... 84/454
5,814,748 A * 9/1998 Reyburn ..... 84/454
5,824,929 A * 10/1998 Freeland et al. ..... 84/454
5,929,358 A * 7/1999 Reyburn ..... 84/454
6,066,790 A * 5/2000 Freeland et al. ..... 84/454
6,291,755 B1 * 9/2001 Hine et al. ..... 84/454
6,479,738 B1 * 11/2002 Gilmore ..... 84/454
6,529,843 B1 * 3/2003 Carpenter ..... 702/75
6,580,024 B2 * 6/2003 Skubic ..... 84/477 R
6,613,971 B1 * 9/2003 Carpenter ..... 84/454
6,627,806 B1 * 9/2003 Carpenter ..... 84/454
6,894,212 B2 * 5/2005 Capano ..... 84/454
7,102,072 B2 * 9/2006 Kitayama ..... 84/616
2005/0211064 A1 * 9/2005 Chiba ..... 84/454
2006/0027074 A1 * 2/2006 Masuda et al. ..... 84/454

* cited by examiner

*Primary Examiner*—Lincoln Donovan
*Assistant Examiner*—Robert W. Horn
(74) *Attorney, Agent, or Firm*—Adams & Wilks

(57) ABSTRACT

The tuning device also includes an input unit for inputting a sound of an instrument to be tuned or a musical sound signal, a conversion information storing portion in which a plurality of pieces of information on filters for tuning are stored, a control unit for extracting the piece of information on an arbitrary one of the filters from the conversion information storing portion, and a conversion unit for converting a signal of the input unit into a signal of an arbitrary frequency band in response to a signal from the control unit. Owing to this structure, even if ambient noise has mixed with a sound of the instrument to be tuned, the sound is filtered into a signal component of a target scale or a target pitch name. By extracting a pitch from this signal component, the number of erroneous tuning operations can be reduced.

14 Claims, 7 Drawing Sheets

FIG. 3

| VALUE A | VALUE B | | | | | | | | | | | |
|---|---|---|---|---|---|---|---|---|---|---|---|---|
| | 000000 | 000001 | 000010 | 000011 | 000100 | 000101 | 000110 | 000111 | 001000 | 001001 | 001010 | ··· |
| | TYPE OF MUSICAL INSTRUMENT | | | | OCTAVE | PITCH NAME | F0 | Fc+ | Fc− | CLOCK PULSE | OTHER | ··· |
| 000000 | MODEL A | MODEL B | MODEL C | MODEL D | 4 | C | 261.63 | F0+α | F0−α | β | ··· | ··· |
| 000001 | | | | | 4 | C# | 277.18 | F0+α | F0−α | β | ··· | ··· |
| 000010 | | | | | 4 | D | 293.66 | F0+α | F0−α | β | ··· | ··· |
| 000011 | | | | | 4 | D# | 311.13 | F0+α | F0−α | β | ··· | ··· |
| 000100 | | | | | 4 | E | 329.63 | F0+α | F0−α | β | ··· | ··· |
| 000101 | | | | | 4 | F | 349.23 | F0+α | F0−α | β | ··· | ··· |
| 000110 | | | | | 4 | F# | 369.99 | F0+α | F0−α | β | ··· | ··· |
| 000111 | | | | | 4 | G | 392.00 | F0+α | F0−α | β | ··· | ··· |
| 001000 | | | | | 4 | G# | 415.30 | F0+α | F0−α | β | ··· | ··· |
| 001001 | | | | | 4 | A | 440.00 | F0+α | F0−α | β | ··· | ··· |
| 001010 | | | | | 4 | A# | 466.16 | F0+α | F0−α | β | ··· | ··· |
| 001011 | | | | | 4 | B | 493.88 | F0+α | F0−α | β | ··· | ··· |
| 001100 | | | | | 5 | C | 523.25 | F0+α | F0−α | γ | ··· | ··· |
| 001101 | | | | | 5 | C# | 554.37 | F0+α | F0−α | γ | ··· | ··· |
| 001110 | | | | | 5 | D | 587.33 | F0+α | F0−α | γ | ··· | ··· |
| 001111 | | | | | 5 | D# | 622.25 | F0+α | F0−α | γ | ··· | ··· |
| 010000 | | | | | 5 | E | 659.26 | F0+α | F0−α | γ | ··· | ··· |
| 010001 | | | | | 5 | F | 698.46 | F0+α | F0−α | γ | ··· | ··· |
| 010010 | | | | | 5 | F# | 739.99 | F0+α | F0−α | γ | ··· | ··· |
| 010011 | | | | | 5 | G | 783.99 | F0+α | F0−α | γ | ··· | ··· |
| 010100 | | | | | 5 | G# | 830.61 | F0+α | F0−α | γ | ··· | ··· |
| 010101 | | | | | 5 | A | 880.00 | F0+α | F0−α | γ | ··· | ··· |
| 010110 | | | | | 5 | A# | 932.33 | F0+α | F0−α | γ | ··· | ··· |
| 010111 | | | | | 5 | B | 987.77 | F0+α | F0−α | γ | ··· | ··· |
| 011000 | | | | | 6 | C | 1,046.50 | F0+α | F0−α | δ | ··· | ··· |
| 011001 | | | | | 6 | C# | 1,108.73 | F0+α | F0−α | δ | ··· | ··· |
| 011010 | | | | | 6 | D | 1,174.66 | F0+α | F0−α | δ | ··· | ··· |
| 011011 | | | | | 6 | D# | 1,244.51 | F0+α | F0−α | δ | ··· | ··· |
| 011100 | | | | | 6 | E | 1,318.51 | F0+α | F0−α | δ | ··· | ··· |
| 011101 | | | | | 6 | F | 1,396.91 | F0+α | F0−α | δ | ··· | ··· |
| 011110 | | | | | 6 | F# | 1,479.98 | F0+α | F0−α | δ | ··· | ··· |
| 011111 | | | | | 6 | G | 1,567.98 | F0+α | F0−α | δ | ··· | ··· |
| 100000 | | | | | 6 | G# | 1,661.22 | F0+α | F0−α | δ | ··· | ··· |
| 100001 | | | | | 6 | A | 1,760.00 | F0+α | F0−α | δ | ··· | ··· |
| 100010 | | | | | 6 | A# | 1,864.66 | F0+α | F0−α | δ | ··· | ··· |
| 100011 | | | | | 6 | B | 1,975.53 | F0+α | F0−α | δ | ··· | ··· |

TUNING DEVICE AND TUNING METHOD

BACKGROUND OF THE INVENTION

1. Field of the Invention

The present invention relates to a tuning device for measuring and displaying a difference between a fundamental frequency of an instrumental sound or a musical sound signal and a reference frequency serving as a criterion for comparison.

2. Description of the Related Art

It has been generally known to remove a certain quantity of unnecessary components such as noise and harmonic components outside a range enabling the tuning of an instrument sound or a musical sound signal (i.e., a range from low pitch sounds to high pitch sounds) by means of a passive filter composed of a resistor and a capacitor, an active filter constructed of an operational amplifier, or the like, as disclosed in JP 9-6341 A (page, 4 FIG. 1).

A conventional tuning device is a fixed filter designed to remove noise and harmonic components outside a tuning-permitting range (i.e., a tonal range from low pitch sounds to high pitch sounds) and thus cannot exercise a filtering effect on unnecessary sounds within a range enabling the tuning of sounds other than those of an instrument to be tuned. As this phenomenon, it is possible to mention tuning in an environment surrounded by many instruments as in the case of, for example, a brass band. In such an environment, the tuning device is susceptible to the influence of ambient sounds and quite often makes an erroneous determination as a response to sounds of an instrument to be tuned.

Further, there is also a method of performing tuning by attaching a piezoelectric pickup to an instrument to avert the influence of ambient sounds and inputting an output signal from the piezoelectric pickup. However, the piezoelectric pickup may pick up not only the musical sounds to be tuned but also the sounds of other instruments in the neighborhood, including brass instruments resounding at high volume, as conductive noise. This constitutes a factor behind erroneous determinations made by the tuning device.

Still further, in the case of Taisho harps or in school lessons, there are often several performers lined up along a single desk to play instruments. In tuning the instruments in such situations, the above-mentioned conductive noise or vibrating sound causes erroneous determinations noticeably.

SUMMARY OF THE INVENTION

In consideration of the aforementioned circumstances, it is an object of the present invention to provide a tuning device capable of reducing the number of erroneous determinations on tuning resulting from noise.

A tuning device of the present invention has a conversion means for converting a signal inputted from the outside into a signal within a desired frequency band, a conversion information storing portion in which parameters corresponding to a filter suited for a frequency of a scale or pitch name as a tuning target are stored, and a control means for controlling the conversion means on the basis of a desired piece of information fetched from the conversion information storing portion. Owing to this structure, even if ambient noise has mixed with a sound of an instrument to be tuned, filtering can be carried out to obtain a signal similar to a signal component of a target scale or pitch name. By extracting a pitch from the signal, the number of erroneous operations in tuning is reduced.

The tuning device has such a feature that tuning can be carried out quickly and reliably even in a tumultuous environment by making it difficult to affect the tuning of the instrument within a range of the scale or pitch name as a tuning target. Further, if a user has a plurality of instruments, he or she sets the conversion means to a frequency band matching a selected mode such as an instrument to be tuned from the outside via an input means or a string of a stringed instrument. By performing a tuning operation taking account of a tonal range of the instrument, the user can accurately tune the instrument with little influence of ambient noise. This is another feature of the present invention.

Furthermore, according to the present invention, more accurate tuning can be carried out with little influence of external noise by selecting a chromatic pitch name as a tuning target within a narrower range than a tonal range of an instrument and setting the conversion means to a frequency band corresponding to the selected pitch name. This is still another feature of the present invention.

In the tuning device of the present invention, appropriate filtering can be carried out for a signal component of a scale or pitch name of an inputted instrumental sound. In addition, by repeating this operation, an optimal filter processing performance of automatic follow-up type is obtained along with an operation of reducing the influence of ambient noise. By extracting a pitch from the signal of the instrumental sound under such an operation, an effect of reducing the number of erroneous operations in tuning is achieved even in an environment plentiful in ambient noise.

Further, by conducting a desired setting as to, for example, an instrument to be tuned or a chromatic pitch name via the setting portion from the outside, an optimal filter processing is performed for a set tonal range. Thus, an operation of reducing the influence of ambient noise for an inputted instrumental sound is obtained. By extracting a pitch from a musical sound under such an operation, the number of erroneous operations in tuning is reduced. As a result, an effect of enabling accurate tuning even under an environment plentiful in instruments and susceptible to the influence of noise is achieved.

BRIEF DESCRIPTION OF THE DRAWINGS

In the accompanying drawings:

FIG. 3 is a table;

DETAILED DESCRIPTION OF THE PREFERRED EMBODIMENTS

Embodiments of a tuning device according to the present invention will be described in detail with reference to the drawings.

Figure 1:
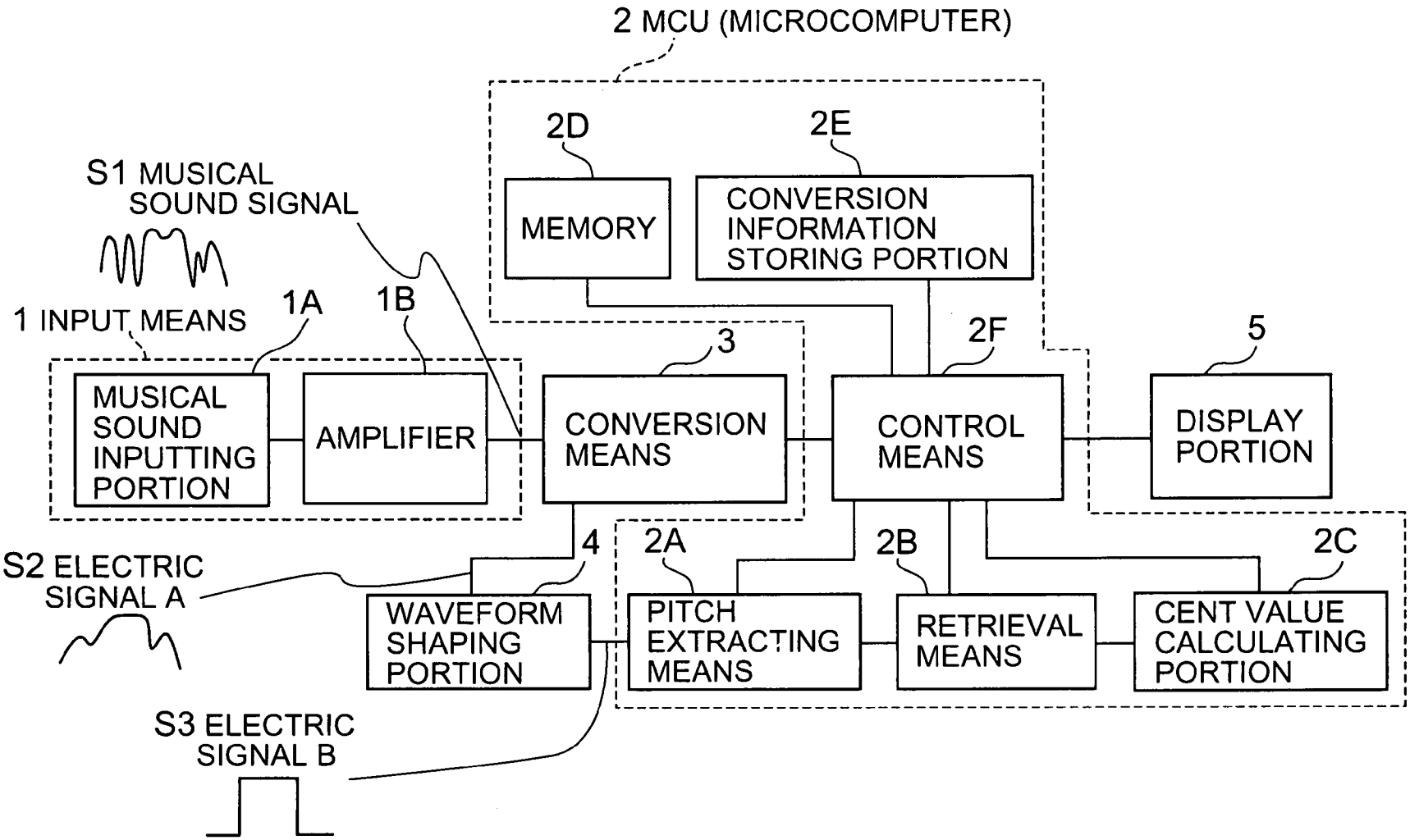
FIG. 1 is a block diagram showing a structure of a tuning device according to the present invention.

FIG. 1 is a block diagram showing a structure of a tuning device to which the present invention is applied. A microcomputer 2 controls the overall operation of this tuning device. The microcomputer includes a memory 2D that is composed of a read-only memory in which a program for controlling the operation of the entire tuning device and the like are stored, a random access memory as a working area required in executing the program, and the like.

A musical sound inputting portion 1A as an input means 1, which is a member for inputting an electric signal of a sound emitted from an instrument, is composed of a microphone for converting a sound into an electric signal, a jack for inputting an electric signal of an instrument, and the like. An amplifier 1B, which is a low-frequency amplifier for amplifying an electric signal of the musical sound inputting portion 1A, outputs an amplified musical sound signal S1 to a conversion means 3.

The conversion means 3, which is a filter circuit to be described later, outputs to a waveform shaping portion 4 an electric signal S2 with a certain frequency band that has passed a desired filter based on a conversion information storing portion 2E. Filter information as shown in a later-described table of FIG. 3 is stored in the conversion information storing portion 2E. In response to a signal outputted from the conversion means 3, the waveform shaping portion 4 outputs a waveform-shaped electric signal S3 (rectangular wave) to the MCU (microcomputer) 2.

A pitch extracting portion 2A as a pitch extracting means, a retrieval means 2B, a cent value calculating portion 2C, the memory 2D, the conversion information storing portion 2E, and a control means 2F are preferably structured as a microcomputer.

The pitch extracting portion 2A measures a time interval every time a rectangular wave as indicated by an electric signal S3 rises or falls, and extracts the electric signal S2, that is, a pitch (cycle) of the musical sound signal S1. A signal with the extracted pitch is outputted to the retrieval means 2B.

The retrieval means 2B compares the signal with the extracted pitch with pieces of reference cycle data on octave (an interval with full 8 degrees) and pitch name (a designation allocated to each of 12 different sounds contained in each octave) as stored in the memory 2D, and calculates a chromatic (a designation allocated to each of 12 semitones constituting one octave, namely, an interval with full 8 degrees) pitch name from that piece of reference cycle data which is similar to the extracted pitch. The retrieval means 2B outputs a calculated chromatic signal to the cent value calculating portion 2C and the control means 2F, and outputs a pitch signal to the cent value calculating portion 2C.

In response to the chromatic semitone signal retrieved by the retrieval means 2B, the cent value calculating portion 2C reads a piece of reference data on one cent of a relevant semitone from pieces of reference data corresponding to respective cents (each representing an interval of more or less a hundredth part of a chromatic semitone) of chromatic semitones stored in the memory 2D. Further, the cent value calculating portion 2C calculates a cent value for the chromatic semitone on the basis of the piece of reference data on the relevant semitone and the signal with the extracted pitch, and outputs the cent value to the control means 2F.

In response to the signals outputted from the retrieval means 2B, the cent value calculating portion 2C, and the like, the control means 2F outputs to the display portion 5 a signal for displaying pieces of tuning information such as octave, pitch name, and cent value.

The display portion 5 performs its display function in the form of a pointer-type meter, a liquid crystal display element, or an LED element.

The tuning device structured as described above can also be carried around if a portable battery such as an electric cell is used as a power source.

The operation of the tuning device will be described hereinafter.

In the conversion information storing portion 2E, pieces of information on conversions carried out for instrument models, octaves, and pitch names, and pieces of information on filters are stored for several kinds of frequency bands, for example, as is apparent from the table shown in FIG. 3.

In response to a chromatic semitone signal from the retrieval means 2B, the control means 2F reads a piece of information on frequency band from the conversion information storing portion 2E based on the table of FIG. 3 corresponding to the signal. Further, the control means 2F outputs the read piece of information to the conversion means 3 and sets the conversion means 3 within a desired frequency band.

A switched capacitor filter can be mentioned as an example of the conversion means 3. It should be noted herein that the term "switched capacitor" means a method of obtaining a characteristic such as variable resistance by controlling an analog switch in an on-off manner with clock pulses by use of the analog switch and a capacitor in combination. The switched capacitor filter is a variable filter utilizing this method and can handle various filter characteristics including band-pass and low-pass characteristics. For clock pulse control or filter control, a microcomputer is often used. Alternatively, as another example of the conversion means 3, a digital filter performing time-division processings can also be utilized. In the case where the conversion means 3 is a switched capacitor filter, pieces of information on frequency band and pieces of information on clock pulses corresponding to tonal ranges, various filter characteristics, and the like are outputted from the control means 2F.

An example of this desired filter will be described with reference to FIG. 3.

Figure 4:
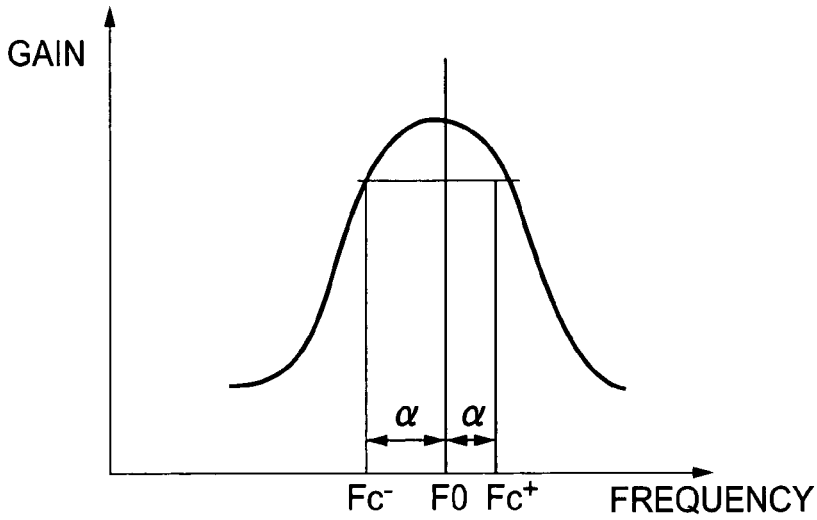
FIG. 4 is an explanatory diagram of a filter.

FIG. 3 is a table showing exemplary parameters of band-pass filters for chromatics. Each value A in the leftmost column represents an exemplary tonal range from low tones starting with a pitch name C (000000) in the fourth octave to high tones ending with a pitch name B (100011) in the sixth octave. The value A corresponds to an address of the conversion information storing portion 2E. Shown to the right of this value A are instrument models as data, an octave, a pitch name, and a corresponding center frequency F0 in this order. Shown to the right of this center frequency F0 are parameters of a band-pass filter illustrated in FIG. 4, namely, a low-pass cut-off frequency Fc+ (F0+$\alpha$) obtained by adding $\alpha$ to the center frequency F0, a high-pass cut-off frequency Fc− (F0−$\alpha$) obtained by subtracting $\alpha$ from the center frequency F0, and a switching clock pulse ($\beta$, $\gamma$, $\delta$) in this order. In an actual operation, a preferred filter coefficient is assigned and a filter response (which is called a filter gradient and assigned to, for example, the item of "other" in the column on the right side in FIG. 3) or the like is given. Thus, in response to a signal from the control means 2F, the conversion means 3 outputs the electric signal S2, which is less susceptible to a malfunction in pitch extraction resulting from noise reduction than the electric signal S1, to the waveform shaping portion 4.

This series of operations will be described as to respective steps with reference to flowcharts of FIGS. 5 and 6.

Figure 5:
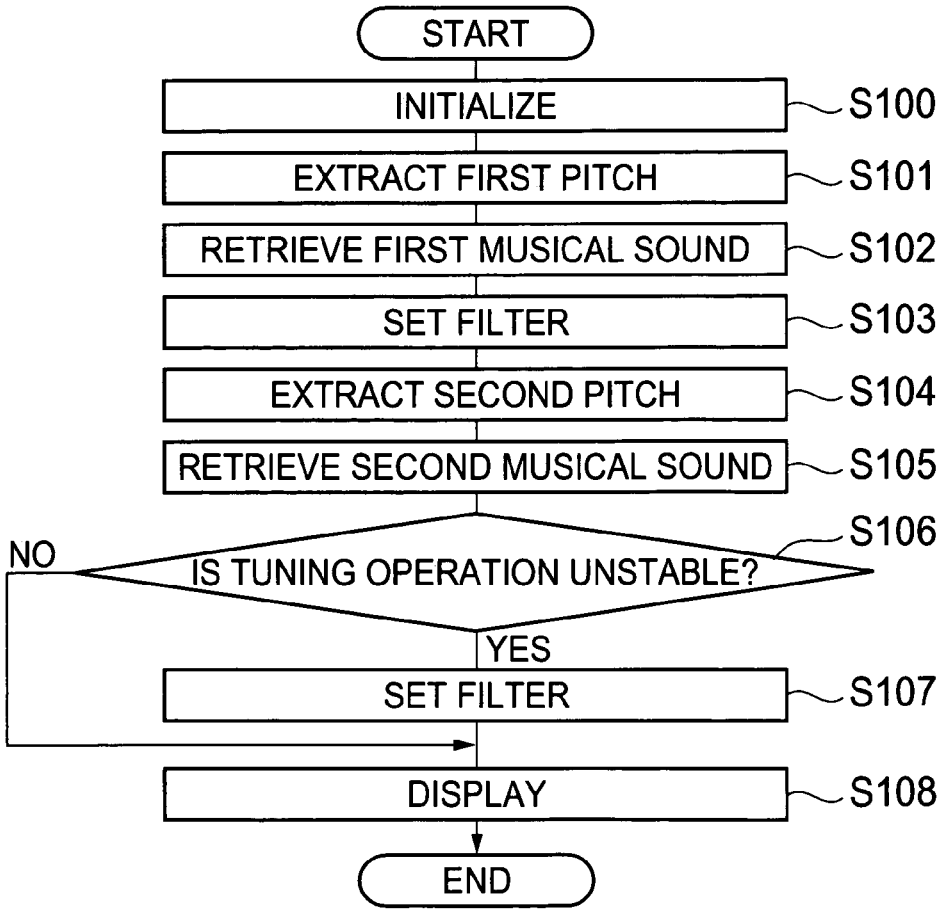
FIG. 5 is a flowchart of a main routine.
Figure 6:
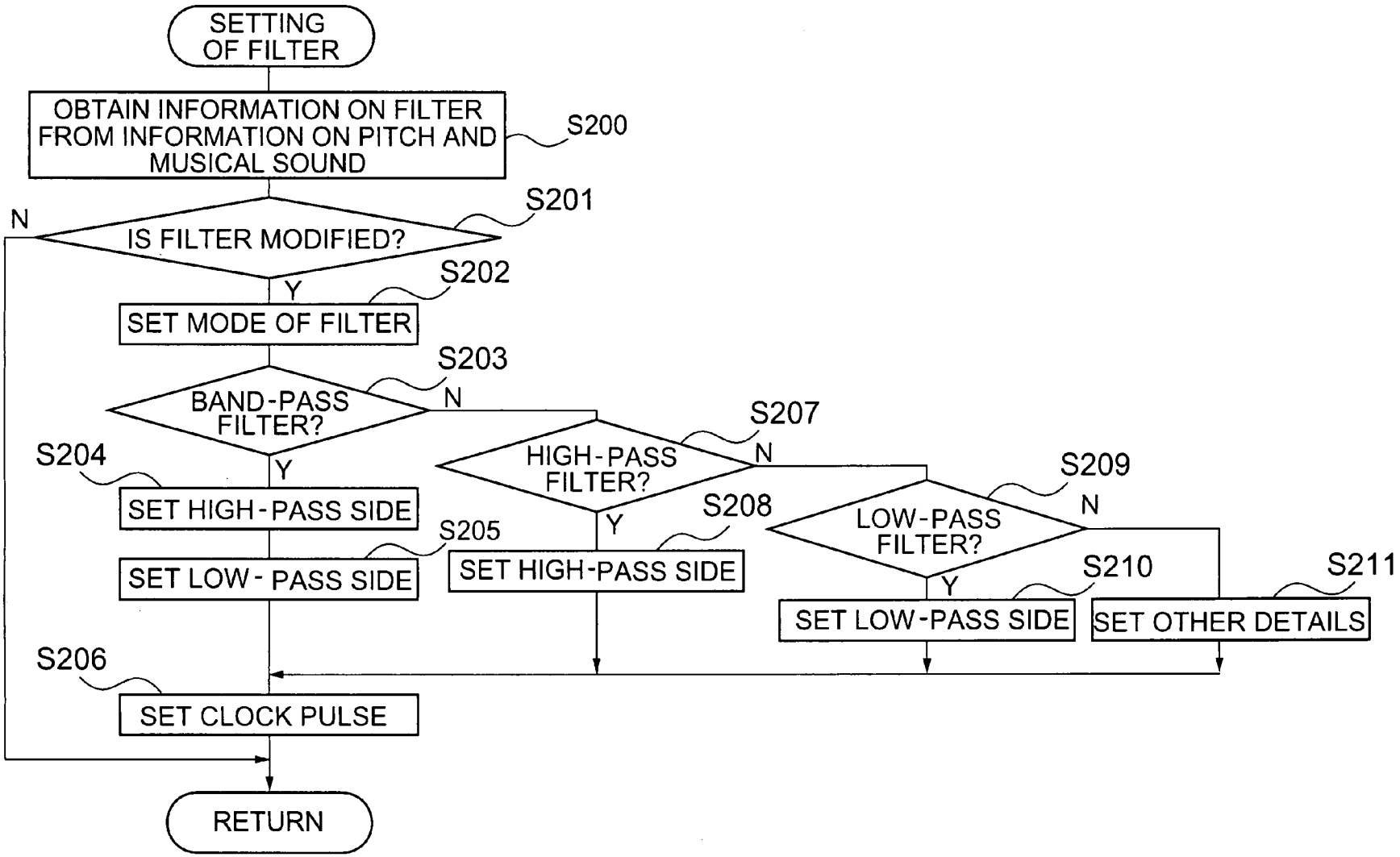
FIG. 6 is a flowchart for setting a filter.

FIG. 5 shows a main routine of the tuning device of the present invention.

An initialization step S100 in FIG. 5 represents a processing performed upon activation of the tuning device to initialize various buffers, registers, parameters, and the like. In this step, the setting of the conversion means 3, that is, the filter is initialized as well. In this case, it is desirable to initialize the filter according to a flat characteristic for an operational range of the tuning device. After the initialization step S100 has been terminated, a transition to a first pitch extracting step S101 is made.

The first pitch extracting step S101 is a processing of extracting a first pitch. This step is intended to extract a pitch of an inputted musical sound and subject the pitch of the musical sound to an adjustment starting from the initialization of the filter. After the first pitch extracting step S101 has been terminated, a transition to a first musical sound retrieving step S102 is made.

The first musical sound retrieving step S102 is a first musical sound retrieving processing performed to retrieve a notation of a chromatic semitone from the pitch extracted in the first pitch extracting step S101. In this case, it is also acceptable to calculate a cent value while the notation of the semitone is retrieved. After the processing of the first musical sound retrieving step S102 has been terminated, a transition to a first filter setting step S103 is made.

The first filter setting step S103 is a filter setting routine to be described later. This step is intended to set the filter again in a preferred manner, for example, to a frequency close to that of the inputted musical sound, after the filter has been initialized (according to the flat characteristic for a tuning range). After the processing of this step has been terminated, a transition to a second pitch extracting step S104 is made.

The second pitch extracting step S104 is a processing of extracting a second pitch. This step is intended to ensure extraction of a stable pitch via the filter set again in the first filter setting step S103. After the processing of the second pitch extracting step S104 has been terminated, a transition to a step S105 is made.

The step S105 is a second musical sound retrieving processing performed to retrieve a notation of a chromatic semitone from the pitch extracted in the second pitch extracting step S104. In this case as well, it is acceptable to calculate a cent value while the notation of the semitone is retrieved. After the processing of the step S105 has been terminated, an operation confirming step S106 is made.

The operation confirming step S106 is a processing of confirming tuning stability on the basis of the extracted pitch and the result of retrieval of the musical sound. If tuning is unstable, a transition to a second filter setting step S107 as a routine of setting a filter is made. If tuning is stable, a transition to a step S108 is made.

The step S108 is a display processing of causing the display portion 5 to display a tuning state of the inputted musical sound. This main routine ends with the step S108. By repeating this main routine each time the processing of inputting a musical sound is performed, a filtering effect with an automatic follow-up to the musical sound is achieved. Consequently, the more stable extraction of a pitch is made possible.

The first filter setting step S103 and the second filter setting step S107 are routines of setting the filter, which will be described with reference to FIG. 6. In a step S200 of FIG. 6, for example, an acquired pitch, the notation of a semitone, and pieces of information on the setting of the filter are obtained from a table of the parameters as shown in FIG. 3. After the processing of the step S200 has been terminated, a transition to a step S201 is made. In the step S201, it is confirmed whether or not the filter has been changed from its initialized state and whether or not there has been a change in the setting of the filter since the execution of a routine activated as a result of tuning unstableness. Even if only a part of the setting of the filter has been changed, a transition to a step S202 is made. If the same state as the last time has been maintained, namely, if no change has been made, a withdrawal from this routine is made.

The step S202 is a processing of setting a suitable filter selected from various filters such as a band-pass filter, a low-pass filter, and a high-pass filter with the aid of the parameters processed in the step S200. After the processing of the step S202 has been terminated, a transition to a step S203 is made.

The step S203 is a processing of confirming whether or not the band-pass filter has been selected. If the band-pass filter has been selected, a transition to a step S204 is made. If not, a transition to a step S207 is made.

In the step S204, the setting of a high-pass side (for cutting low frequencies) of the band-pass filter is made. After this processing has been terminated, a transition to a step S205 is made.

In the step S205, the setting of a low-pass side (for cutting high frequencies) of the band-pass filter is made. After the processing of the step S205 has been terminated, a transition to a step S206 is made. In setting the band-pass filter, the processings of the steps S204 and S205 may be permutated.

The step S207 is a processing of confirming whether or not the high-pass filter has been selected. If the high-pass filter has been selected, a transition to a step S208 is made. If not, a transition to a step S209 is made.

In the step S208, the high-pass filter is set. After this processing has been terminated, a transition to the step S206 is made.

The step S209 is a processing of confirming whether or not the low-pass filter has been selected. If the low-pass filter has been selected, a transition to a step S210 is made. If not, a transition to a step S211 is made.

In the step S210, the low-pass filter is set. After this processing has been terminated, a transition to the step S206 is made.

In the step S211, the setting of other filters, a band elimination filter, for example, is made.

After the processing of the step S211 has been terminated, a transition to the step S206 is made.

The step S206 is a processing performed in the case where the conversion means 3 uses clock pulses for controlling the switched capacitor filter or the like. The setting of clock pulses is made referring to the information acquired in the step S200.

After the processing of the step S206 has been terminated, a withdrawal from this routine is made. Thus, the operations of the components constituting the MCU (microcomputer) 2, namely, the conversion information storing portion 2E, the control means 2F, the pitch extracting portion 2A described above, the retrieval means 2B, the cent value calculating portion 2C, and the memory 2D can be realized by the aforementioned program.

Figure 2:
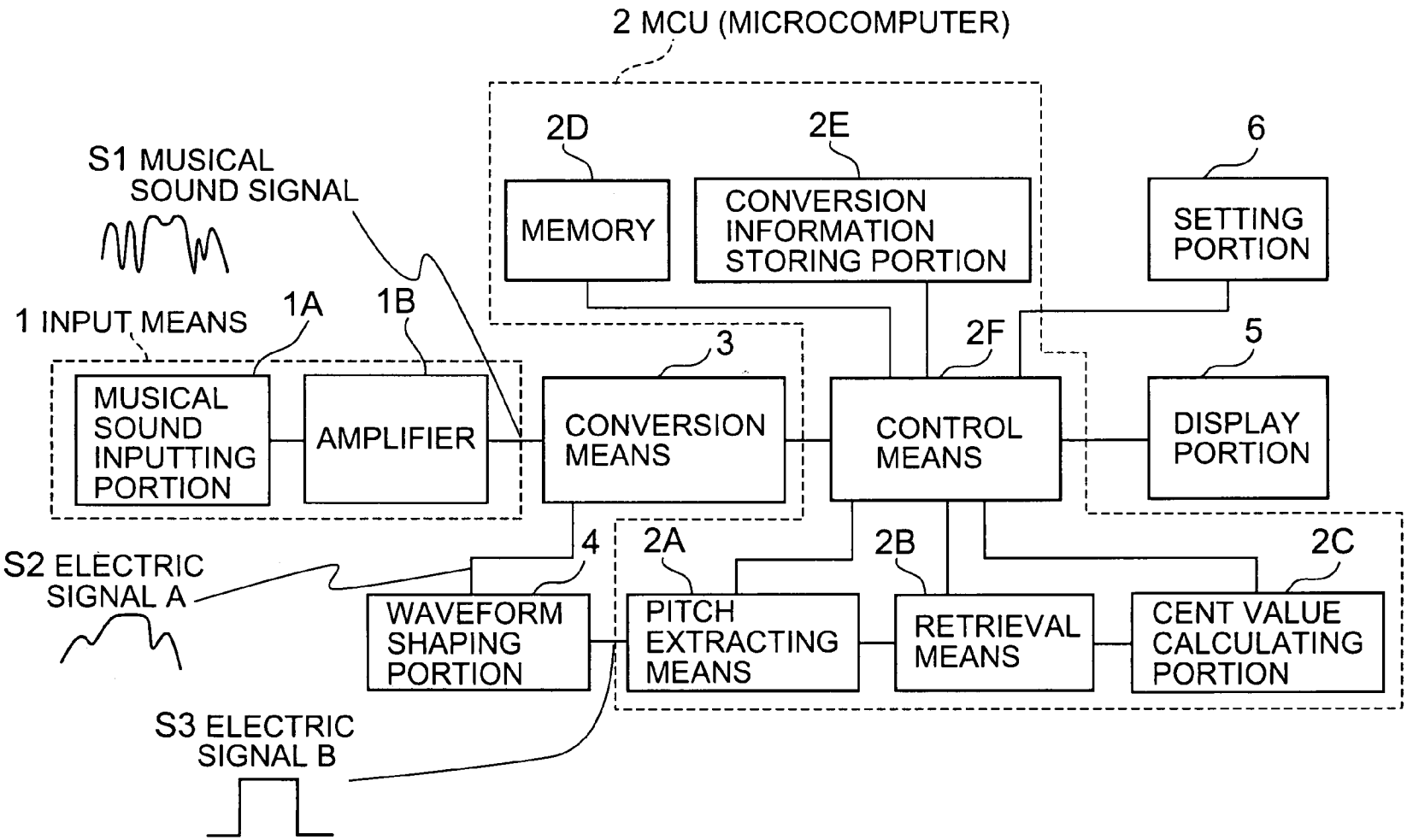
FIG. 2 is a block diagram showing a second embodiment.

Next, reference will be made to FIG. 2, which is a block diagram showing the second embodiment. In this block diagram, the musical sound inputting portion 1A, the amplifier 1B, the conversion means 3, the waveform shaping means 4, the MCU (microcomputer) 2, the pitch extracting portion 2A, the musical sound retrieving portion 2B, the cent value calculating portion 2C, the memory 2D, the conversion information storing means 2E, and the display portion 5 may be designed to perform the same operations as those described with reference to the block diagram of FIG. 1. A setting portion 6, which is a means for performing operations of selecting an instrument to be tuned, a string of a stringed instrument, or a chromatic pitch name from the outside, is constituted by, for example, a switch circuit for generating a switch signal by opening and closing a switch member. This switch signal is outputted to the control means 2F inside the MCU (microcomputer) 2. In response to a signal from the setting portion 6, the control means 2F reads from the conversion information storing portion 2E a piece of filter information based on the signal and outputs it to the conversion means 3. The conversion means 3 performs the same operation as the variable filter circuit described with reference to the block diagram of FIG. 1. The conversion means 3 constitutes a desired filter based on an output signal of the control means 2F, and outputs to the waveform shaping portion 4 the electric signal S2 that has passed through the filter.

This series of operations will be described with reference to flowcharts shown in FIGS. 7 and 8.

Figure 7:
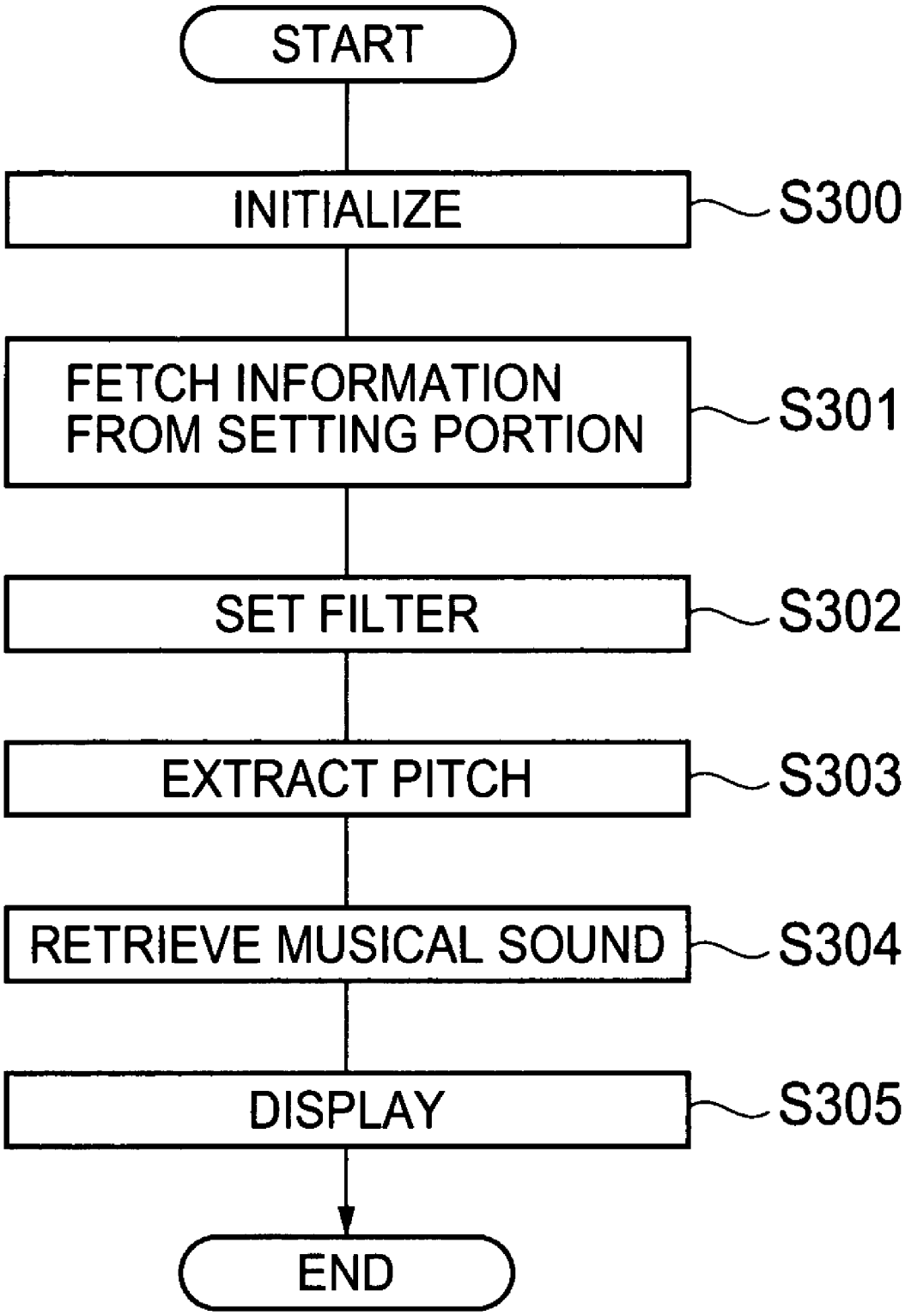
FIG. 7 is a flowchart of a main routine of the second embodiment.
Figure 8:
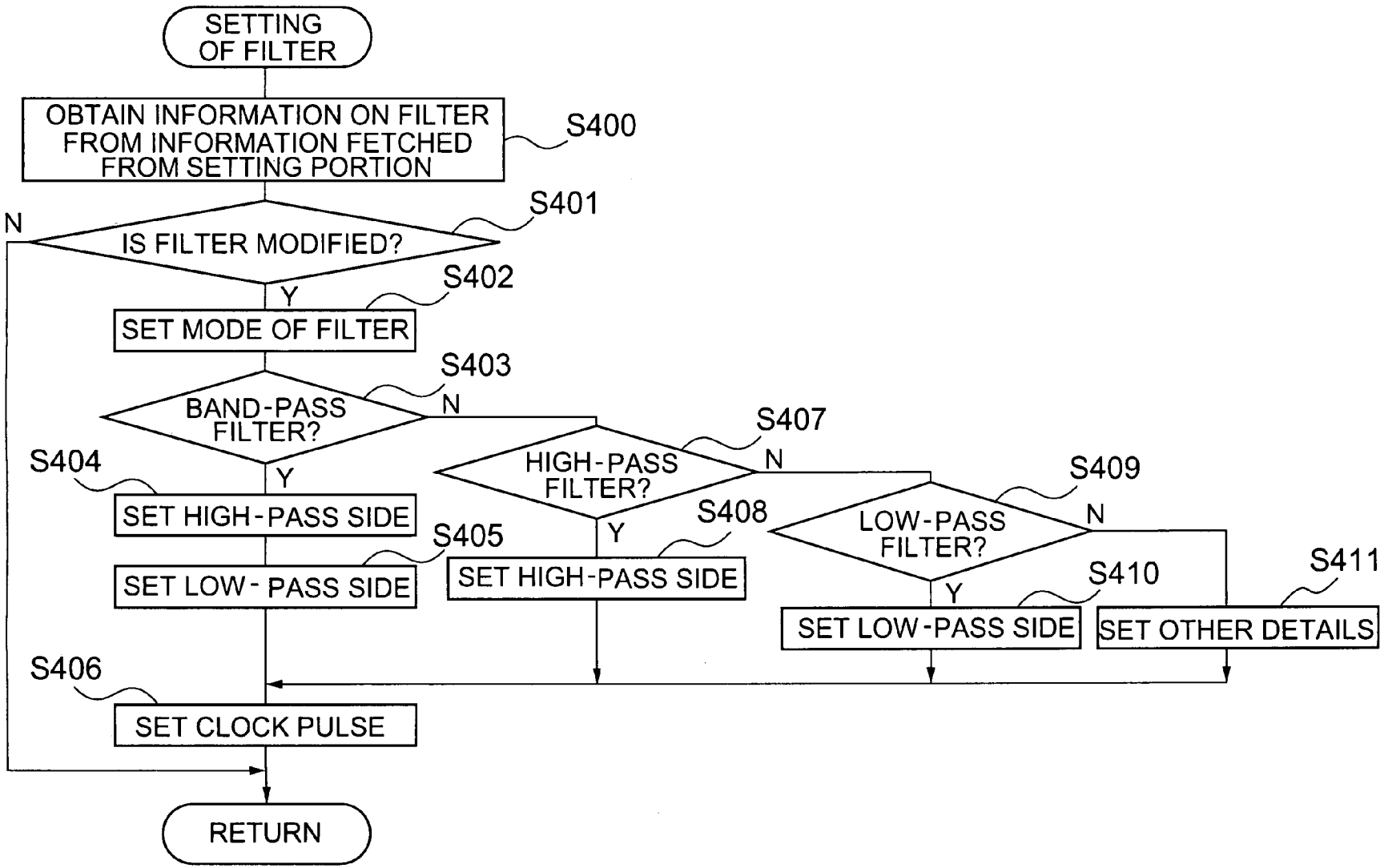
FIG. 8 is a flowchart for setting a filter in the second embodiment.

FIG. 7 shows a main routine of the second embodiment. An initialization step S300 in FIG. 7 is a processing performed upon activation of the tuning device. In this processing, various buffers, registers, parameters, and the like are initialized. After the initialization step S300 has been terminated, a transition to an outside information fetching step S301 is made.

The outside information fetching step S301 is a processing of fetching a piece of information received via the setting portion 6 as to an instrument to be tuned, a string of a stringed instrument, a chromatic pitch name, or the like. After the outside information fetching step S301 has been terminated, a transition to a filter setting step S302 is made.

The filter setting step S302 is a filter setting routine to be described later. After this routine has been terminated, a transition to a pitch extracting step S303 is made. The pitch extracting step S303 is a processing of extracting a pitch. After this processing has been terminated, a transition to a musical sound retrieving step S304 is made.

The musical sound retrieving step S304 is a processing of retrieving a musical sound. In this processing, a notation of a chromatic semitone is retrieved from the pitch extracted in the pitch extracting step S303. In this case as well, it is acceptable to calculate a cent value while the notation of the semitone is retrieved. After the processing of the musical sound retrieving step S304 has been terminated, a transition to a step S305 is made.

The step S305 is a display processing of causing the display portion 5 to display a tuning state of the inputted musical sound. This main routine ends with the step S305.

The filter setting step S302 is a routine of setting the filter, which will be described with reference to FIG. 8. In a step S400 of FIG. 8, pieces of information on the setting of the filter are obtained from, for example, a table of parameters as shown in FIG. 3, based on a piece of information received via the setting portion 6 as to an instrument to be tuned, a string of a stringed instrument, or a chromatic pitch name. After the processing of the step S400 has been terminated, a transition to a step S401 is made.

If there is a change in the setting of the filter in the step S401, a transition to a step S402 is made. If the same state as the last time has been maintained, namely, if no change has been made, a withdrawal from this routine is made.

The step S402 is a processing of setting a suitable filter selected from various filters such as a band-pass filter, a low-pass filter, and a high-pass filter with the aid of the parameters processed in the step S400. After the processing of the step. S402 has been terminated, a transition to a step S403 is made.

The step S403 is a processing of confirming whether or not the band-pass filter has been selected. If the band-pass filter has been selected, a transition to a step S404 is made. If not, a transition to a step S407 is made.

In the step S404, the setting of a high-pass side (for cutting low frequencies) of the band-pass filter is made. After this processing has been terminated, a transition to a step S405 is made.

In the step S405, the setting of a low-pass side (for cutting high frequencies) of the band-pass filter is made. After the processing of the step S405 has been terminated, a transition to a step S406 is made. In setting the band-pass filter, the processings of the steps S404 and S405 may be permutated.

The step S407 is a processing of confirming whether or not the high-pass filter has been selected. If the high-pass filter has been selected, a transition to a step S408 is made. If not, a transition to a step S409 is made.

In the step S408, the high-pass filter is set. After this processing has been terminated, a transition to the step S406 is made.

The step S409 is a processing of confirming whether or not the low-pass filter has been selected. If the low-pass filter has been selected, a transition to a step S410 is made. If not, a transition to a step S411 is made.

In the step S410, the low-pass filter is set. After this processing has been terminated, a transition to the step S406 is made.

In the step S411, the setting of other filters, a band elimination filter, for example, is made. After the processing of the step S411 has been terminated, a transition to the step S406 is made.

The step S406 is a processing performed in the case where the conversion means 3 uses clock pulses for controlling the switched capacitor filter or the like. The setting of clock pulses is made referring to the information acquired in the step S400. After the processing of the step S406 has been terminated, a withdrawal from this routine is made.

Thus, the operations of the components constituting the MCU (microcomputer) 2, namely, the conversion information storing portion 2E and the control means 2F can be realized by the aforementioned program. A desired filtering effect can be obtained by controlling the conversion means 3.

What is claimed is:

1. A tuning device that measures a difference between a fundamental frequency of an instrumental sound or a musical sound signal and a reference frequency serving as a criterion for comparison, the tuning device comprising:

a display portion for displaying the difference;

input means for inputting a sound of an instrument to be tuned or a musical sound signal;

a conversion information storing portion in which a plurality of pieces of information on filters for tuning are stored at associated storage addresses;

control means for extracting a piece of information on an arbitrary one of the filters from the associated address within the conversion information storing portion; and conversion means for converting a signal of the input means into a signal of an arbitrary frequency band in response to a signal from the control means.

2. A tuning device according to claim 1; wherein at least two pieces of information on the arbitrary one of the filters are stored in the conversion information storing portion.

3. A tuning device according to claim 1; wherein the conversion means has a variable filter permitting a change into an arbitrary frequency band.

4. A tuning device according to claim 3; wherein the variable filter comprises a switched capacitor filter.

5. A tuning device according to claim 3; wherein the variable filter comprises a digital filter based on a time-division processing.

6. A tuning device according to claim 3; wherein the variable filter has a band-pass filter.

7. A tuning device according to claim 1; wherein the conversion information storing portion and the control means are structured as a microcomputer.

8. A tuning device according to claim 1; wherein the display portion comprises a liquid crystal display element.

9. A tuning device according to claim 1; wherein the display portion comprises an LED element.

10. A tuning device according to claim 1; further comprising a portable battery as a power source.

11. A tuning device that measures a difference between a fundamental frequency of an instrumental sound or a musical sound signal and a reference frequency serving as a criterion for comparison, the tuning device comprising:

a display portion for displaying the difference;

a setting portion for receiving a signal from outside;

input means for inputting a sound of an instrument to be tuned or a musical sound signal;

a conversion information storing portion in which a plurality of pieces of information on filters for tuning are stored at associated storage addresses;

control means for extracting a piece of information on a desired one of the filters from the associated address within the conversion information storing portion in response to a signal from the setting portion; and conversion means for converting a signal of the input means into a signal of an arbitrary frequency band in response to a signal from the control means.

12. A tuning device according to claim 11; wherein the setting portion generates a switch signal by opening and closing a switch.

13. A tuning method for measuring a difference between a fundamental frequency of an instrumental sound or a musical sound signal and a reference frequency serving as a criterion for comparison, the tuning method comprising:

a first pitch extracting step of extracting a first pitch in response to the sound of the instrument or the musical sound signal;

a first musical sound retrieving step of retrieving a first musical sound from the extracted first pitch;

a first filter setting step of acquiring, based on retrieval of the first musical sound or the like, a desired piece of information on a filter for tuning from an address within a conversion information storing portion in which a plurality of pieces of information on the filter for tuning are stored at respective storage addresses, and setting the filter such that an input signal is converted into a signal of an arbitrary frequency band;

a second pitch extracting step of extracting a second pitch in response to the sound of the instrument or the musical sound signal;

a second musical sound retrieving step of retrieving a second musical sound from the extracted second pitch;

an operation confirming step of confirming, based on the first pitch and the second pitch, whether or not a tuning operation is unstable; and a second filter setting step of acquiring, based on retrieval of the second musical sound, a desired piece of information on a filter from an address within the conversion information storing portion if the tuning operation is unstable, and setting the filter such that a input signal is converted into a signal of an arbitrary frequency band.

14. A tuning method for measuring a difference between a fundamental frequency of an instrumental sound or a musical sound signal and a reference frequency serving as a criterion for comparison, the tuning method comprising:

an outside information fetching step of fetching information from a setting portion;

a filter setting step, based on the information fetched from the setting portion, of acquiring a desired piece of information on a filter for tuning from an address within a conversion information storing portion in which a plurality of pieces of information on the filter for tuning are stored at respective storage addresses, and setting the filter such that an input signal is converted into a signal of an arbitrary frequency band;

a pitch extracting step of extracting a pitch in response to the sound of the instrument or the musical sound signal; and a musical sound retrieving step of retrieving a musical note from the extracted pitch.

* * * * *